US010507397B2

(12) United States Patent
Walterscheid

(10) Patent No.: US 10,507,397 B2
(45) Date of Patent: Dec. 17, 2019

(54) VIBRATING TOY

(71) Applicant: FSD, LLC, Bend, OR (US)

(72) Inventor: Steven Edward Walterscheid, Bend, OR (US)

(73) Assignee: FSD, LLC, Bend, OR (US)

( * ) Notice: Subject to any disclaimer, the term of this patent is extended or adjusted under 35 U.S.C. 154(b) by 0 days.

(21) Appl. No.: 16/178,548

(22) Filed: Nov. 1, 2018

(65) Prior Publication Data

US 2019/0143230 A1 May 16, 2019

Related U.S. Application Data

(63) Continuation-in-part of application No. 15/990,023, filed on May 25, 2018.

(60) Provisional application No. 62/586,034, filed on Nov. 14, 2017.

(51) Int. Cl.

| | |
|---|---|
| ***A63H 11/02*** | (2006.01) |
| ***A63H 3/08*** | (2006.01) |
| ***A63H 29/22*** | (2006.01) |

(52) U.S. Cl.

CPC ..... *A63H 11/02* (2013.01); *A63H 3/08* (2013.01); *A63H 29/22* (2013.01)

(58) Field of Classification Search

CPC ..... A63H 11/02; A63H 11/04; A63H 11/06; A63H 11/08; A63H 11/10; A63H 11/12; A63H 11/14; A63H 2011/16; A63H 11/18; A63H 13/00; A63H 29/22

USPC ..... 446/295, 354–356, 369, 456, 462, 465, 446/484

See application file for complete search history.

(56) References Cited

U.S. PATENT DOCUMENTS

| | | | | |
|---|---|---|---|---|
| 2,167,985 A | | 8/1939 | Levay | |
| 3,196,580 A | | 7/1965 | Rakestraw | |
| 3,234,933 A | * | 2/1966 | Martin | A61H 23/0263 601/41 |
| 3,530,617 A | | 9/1970 | Halvorson | |
| 4,183,173 A | | 1/1980 | Ogawa | |
| 4,391,223 A | * | 7/1983 | Holland | A01K 1/033 119/499 |
| 4,759,642 A | * | 7/1988 | Van Erden | B65D 31/00 229/117.35 |
| 4,941,857 A | | 7/1990 | Fujimaki | |
| 5,117,815 A | | 6/1992 | Gentry et al. | |
| 5,163,381 A | * | 11/1992 | Kraski | A01K 1/033 119/28.5 |
| 5,221,226 A | * | 6/1993 | Park | A63H 18/007 446/353 |

(Continued)

OTHER PUBLICATIONS https://www.amazon.com/Wireless-Wand-Waterproof-Rechargeable-Vibrating/dp/B01NBXW3NR/ref=cm_cr_arp_d_product_top?ie=UTF8&th=1> entire document, especially p. 1-3.

(Continued)

*Primary Examiner* — Nini F Legesse

(74) *Attorney, Agent, or Firm* — LaMorte & Associates, P.C.

(57) ABSTRACT

A vibrating toy assembly that can travel along a surface in an unpredictable pattern. The toy assembly is powered by a vibration mechanism. The vibration mechanism has a motor and batteries that are held with a housing. The vibration mechanism is placed into a hollow casing. The hollow casing defines an internal compartment. Once activated, the vibration mechanism vibrates and moves the casing. This causes the overall toy assembly to move in random patterns.

15 Claims, 5 Drawing Sheets

(56) References Cited

U.S. PATENT DOCUMENTS

| | | | | |
|---|---|---|---|---|
| 5,679,047 | A | 10/1997 | Engel | |
| 5,720,644 | A * | 2/1998 | Ku | A63H 11/00 446/175 |
| 5,765,508 | A * | 6/1998 | Markowitz | A01K 15/025 119/707 |
| 5,993,286 | A | 11/1999 | Tacquard | |
| 8,038,503 | B2 | 10/2011 | Norman et al. | |
| 2008/0306417 | A1 | 12/2008 | Imboden et al. | |
| 2011/0147442 | A1 * | 6/2011 | Griffin | B65D 5/60 229/117.27 |
| 2012/0100777 | A1 | 4/2012 | Hsu | |
| 2013/0095723 | A1 | 4/2013 | Sadri et al. | |
| 2014/0094088 | A1 | 4/2014 | Olivera et al. | |
| 2016/0339352 | A1 * | 11/2016 | Liu | A63H 33/16 |
| 2017/0008671 | A1 * | 1/2017 | Whitman | B65D 21/086 |

OTHER PUBLICATIONS

'Cardboard Box' (Wikipedia), Dec. 11, 2018 (Dec. 11, 2018), [online] <URL:https://en.wikipedia.org/wiki/Cardboard_box> entire document.

* cited by examiner

VIBRATING TOY

RELATED APPLICATIONS

This application is a continuation-in-part of co-pending U.S. application Ser. No. 15/990,023, that claims the benefit of U.S. Provisional Application No. 62/586,034, filed Nov. 14, 2017.

BACKGROUND OF THE INVENTION

1. Field of the Invention

In general, the present invention relates to toys that move on a surface due to an internal vibrating mechanism. More particularly, the present invention relates to the structure of the toy and the internal compartment that retains the internal vibration mechanism.

2. Prior Art Description

There are many toys that are designed to vibrate. Many of these toys use vibration mechanisms to move the toys across a surface. The vibration mechanism used within the toy often includes a small battery powered motor. The motor is used to turn an eccentric weight that is mounted to the motor. As the eccentric weight is rotated by the motor, a strong mechanical vibration is created that shares the same frequency as the rotational speed of the eccentric weight. Toys that utilize such vibration mechanisms are exemplified by U.S. Pat. No. 4,941,857 to Fujimaki, and U.S. Patent Application Publication No. 2012/0100777 to Hsu.

In the prior art, the motor used to rotate the eccentric weight is typically positioned in the center of the toy. The eccentric weight rotates in a fixed compartment adjacent to the motor. The weight distribution within the toy and its center of gravity remains relatively constant so the vibrations will not cause the toy to fall over. Accordingly, the effects of the rotating weight on the overall toy remain relatively constant each time the motor is activated. The result is that each time the toy is utilized, the movements of the toy caused by the rotating weight remain standard and predictable.

Additionally, since the vibration mechanism is housed within the toy, the toy is set in shape and appearance. This limits the play value of the toy because a user can quickly become bored with the fixed appearance and fixed movement pattern embodied by the toy.

A need exists for a toy with an internal vibration mechanism that causes random and altering movement patterns as the toy is propelled along a surface. A need also exists for a toy with an internal vibration mechanism having a facade that can be altered, therein selectively changing the appearance of the toy.

These needs are met by the present invention as described and claimed below.

SUMMARY OF THE INVENTION

The present invention is a vibrating toy assembly that can travel along a surface in an unpredictable pattern. The toy assembly is powered by a vibration mechanism. The vibration mechanism has a motor and batteries that are held within a housing. When the batteries power the motor, the motor turns an eccentric weight and vibrations are produced.

The vibration mechanism is set into a base. The vibration mechanism and part of the base are then covered in a lightweight body casing. The body casing can be selectively changed to change the appearance of the toy.

The vibration mechanism causes the base and the body casing it supports to move. Movement is enhanced by providing an opening in the base that enables the vibration mechanism to directly contact the surface underlying the toy assembly. Once activated, the vibration mechanism vibrates and moves the toy assembly in random patterns. Additionally, since the vibration mechanism is separate and distinct from the body casing, different casings can be used to increase the play value of the vibrating toy assembly.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy assembly can have many embodiments, only two exemplary embodiments are shown. The exemplary embodiments are selected in order to set forth two of the best modes contemplated for the invention. The illustrated embodiments, however, are merely exemplary and should not be considered limitations when interpreting the scope of the claims.

Figure 1:
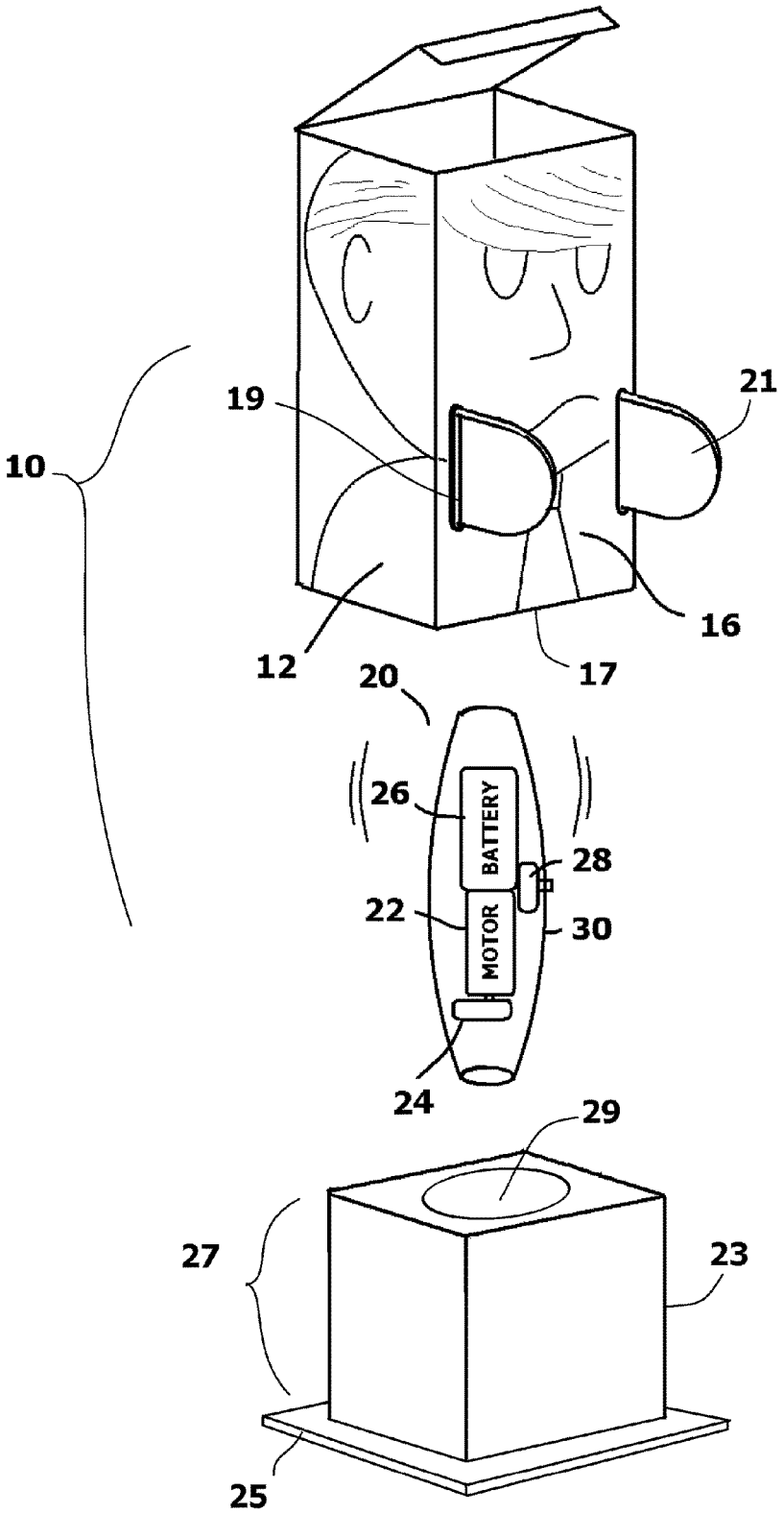
FIG. 1 is a partially exploded view of an exemplary embodiment of a vibrating toy assembly.
Figure 2:
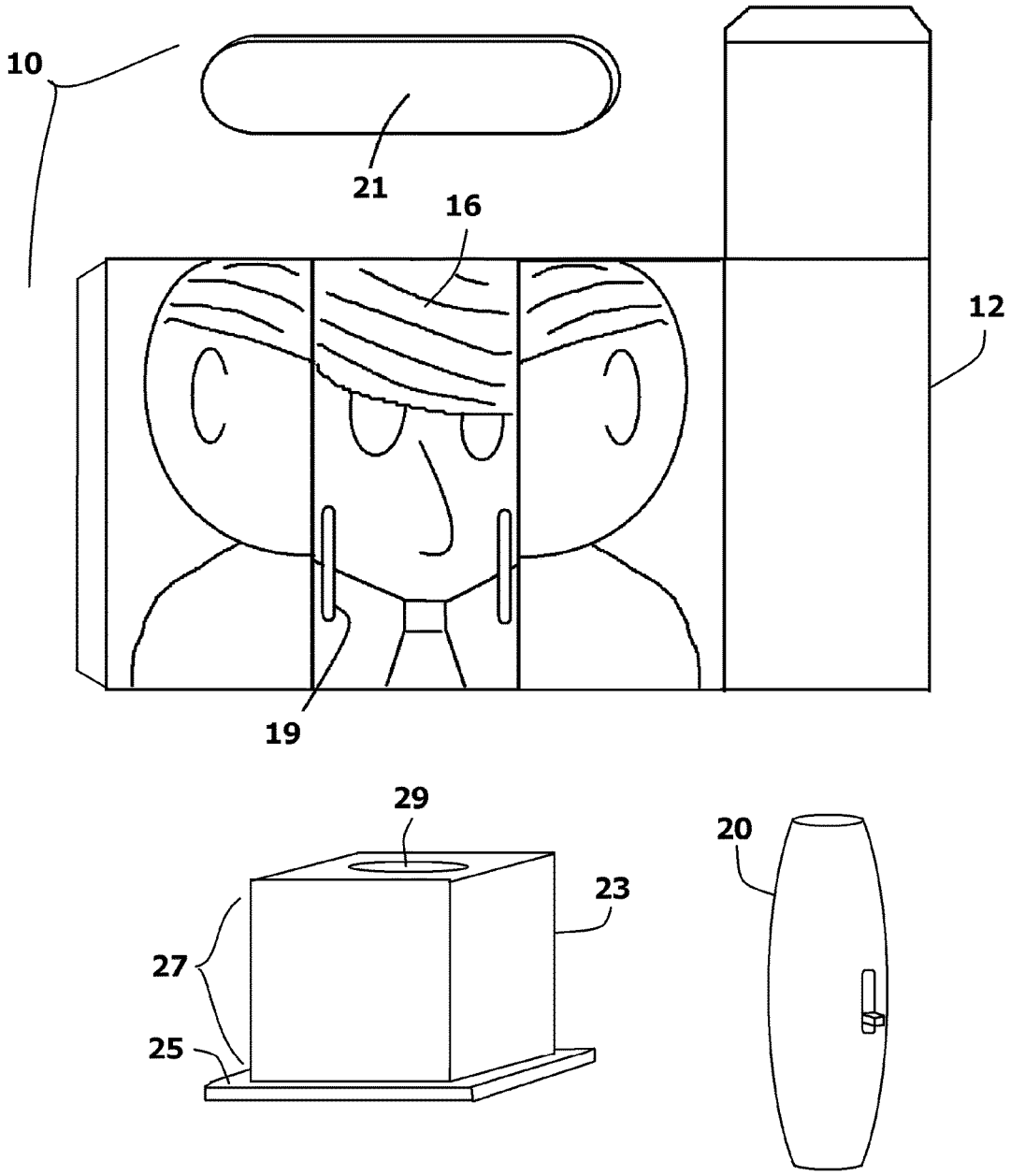
FIG. 2 shows a blank of paper used to form the body casing of the exemplary embodiment.
Figure 3:
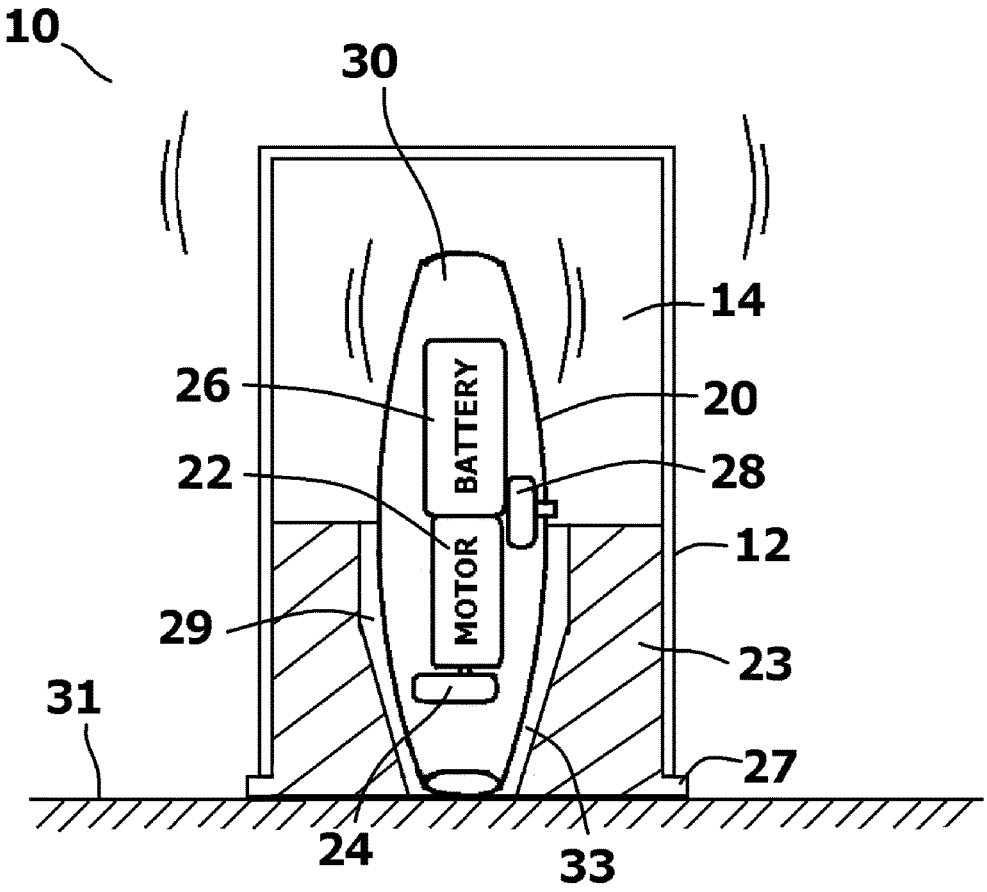
FIG. 3 is a cross-sectional view of the exemplary embodiment of FIG. 1.

Referring to FIG. 1 in conjunction with FIG. 2 and FIG. 3, a toy assembly 10 is shown. The toy assembly 10 includes a body casing 12 that defines a hollow internal compartment 14. The body casing 12 is made of folded paper or folded paperboard, wherein character graphics 16 are printed on the exterior of the body casing 12. The body casing 12 can be pre-formed or provided as a paper blank that folds like a box to form a three-dimensional structure. The body casing 12 can have many shapes. However, when folded, the body casing 12 has an open bottom 17 that provides access to the hollow internal compartment 14. Since the body casing 12 is little more than a paper blank with the character graphics 16 printed upon it, numerous different casings 12 can be sold with only one vibration mechanism 20 without significantly increasing the costs of manufacturing the overall product.

The character graphics 16 on the casing 12 can represent the body of a character. To add arms or other appendages to the casing 12, slots 19 can be formed in the body casing 12. Appendages 21, in the form of folded pieces of paperboard, can be inserted into the slots 19 so that the appendages 21 extend away from the body casing 12. The appendages 21, in addition to improving aesthetics, also prevent the casing 12 from falling flat in the directions of the extending appendages 21. Rather, should the body casing 12 fall forward, the extending appendages 21 can hold the body casing 12 at an inclined angle that enables the casing 12 to again stand upright if vibrated with the proper motion.

A base 23 is provided. The base 23 has a bottom plate 25 with a top surface and a support wall 27 that extends vertically from the top surface of the bottom plate 25. The support wall 27 is sized and shaped to pass into the open bottom 17 of the body casing 12, wherein the body casing 12 engages the support wall 27 with a friction fit. If desired, the friction connection can be supplemented with use of a tacky adhesive. However, it is desirable that the body casing 12 and the base 23 be selectively separable.

The base 23 defines a vertical conduit 29. That is, there is a vertical conduit 29 that extends through the bottom plate 25 and up through the center of the support wall 27. When the toy assembly 10 is standing, the toy assembly 10 rests upon the bottom plate 25 of the base 23. As such, the vertical conduit 29 is exposed to the underlying surface 31 that is below +the standing toy assembly 10.

The vertical conduit 29 forms a receptacle 33 that is sized and shaped to retain a vibration mechanism 20. When the vibration mechanism 20 is received within the receptacle 33, a small section of the vibration mechanism 20 extends through the vertical conduit 29 and beyond the bottom plate 25. Accordingly, when the toy assembly 10 is standing on the base 23, part of the vibration mechanism 20 contacts the underlying surface 31 below the base 23.

The vibration mechanism 20 has a motor 22 that rotates an eccentric weight 24, therein causing vibrations in a traditional manner. The motor 22 is powered by a battery 26. The flow of electricity from the battery 26 to the motor 22 is selectively controlled using an on/off switch 28. The motor 22, eccentric weight 24, battery 26 and on/off switch 28 are all retained in a housing 30. The housing 30 is received and retained by the receptacle 33 in the base 23. It will therefore be understood, that when the on/off switch 28 is turned "on", the motor 22 rotates the eccentric weight 24 and the entire housing 30 vibrates. This vibration is translated to the base 23 and the body casing 12 affixed to the base 23.

The housing 30 of the vibration mechanism 20 is elongated between a first end 32 and second end 34. As such, the housing 30 has a length that is significantly longer than its width. Furthermore, due to the position of the eccentric weight 24, the vibration mechanism 20 has a center of gravity that varies and is never at the geometric center of the housing 30. The result is that when the housing 30 of the vibration mechanism 20 is vertically stood on end, the vibration mechanism 20 is unstable and will naturally tend to fall to one side, even when not vibrating.

The vibration mechanism 20 is placed into the the base 23. The base 23 is then inserted into the open bottom 17 of the body casing 12. The connection of the vibration mechanism 20 to the base 23 prevents the vibration mechanism 20 from falling and maintains the housing 30 of the vibration mechanism 20 in a vertical orientation.

It will be understood that as the vibration mechanism 20 vibrates, it moves and transfers energy to the base 23 and to the body casing 12. This causes the body casing 12 to move. The way the casing 12 moves depends upon the vibrational energy directly transferred to the base 23 and to the body casing 12 by the vibration mechanism 20. The movement of the body casing 12 also depends upon the interaction of the vibration mechanism 20 with the underlying surface 31 below the toy assembly 10. As such, each time the vibration mechanism 20 is activated, its effects upon the movement of the body casing 12 will differ. The results are movement patterns for the body casing 12 and the overall toy assembly 10 that are diverse, unpredictable, and always changing.

Figure 4:
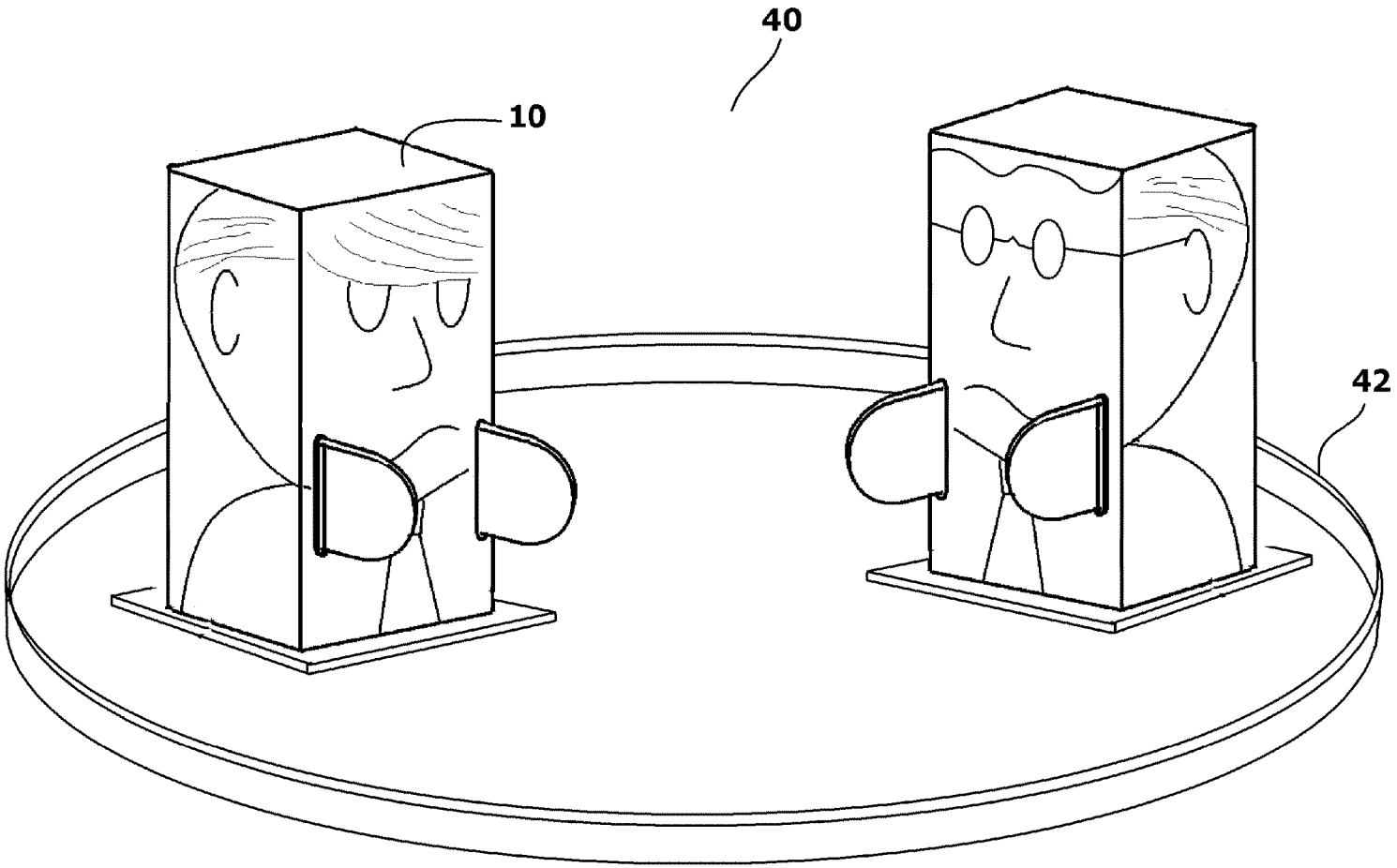
FIG. 4 shows two toy assemblies together with a ring to produce a game playset.

Referring to FIG. 4 in conjunction with FIG. 3, it can be seen that the toy assembly 10 can be marketed as part of a game playset 40. In the game playset 40, two or more toy assemblies 10 are set in a ring 42. The ring 42 can be a circle cut into a piece of paperboard. However, in the shown embodiment, the ring 42 is a simple plastic ring. What is of importance is that the ring 42 presents a physical barrier that prevents any toy assembly 10 from vibrating out of the ring 42. The ring 42 shown is circular. However, other geometries can be used, provided the ring 42 is continuous and provides no pathway out of the ring.

In play, two or more toy assemblies 10 are placed inside the ring 42 after their internal vibration mechanisms have been activated. The toy assemblies 10 will vibrate and will randomly move about in the area defined by the ring 42. The toy assemblies 10 will inevitably crash into one another. Depending upon the speed of the collision, the angle of the collision and the contact positions of the various appendages, one of the toy assemblies 10 will eventually knock over another. Once a toy assembly 10 is knocked over, it may self-right or it may not. This will depend upon its position and internal vibrations. If a toy assembly 10 does not self-right within a few seconds, it is counted out and eliminated from the game. It can be seen that the toy assemblies 10 can be used to create boxing matches, wrestling matches and any other play match where the last toy standing wins.

Figure 5:
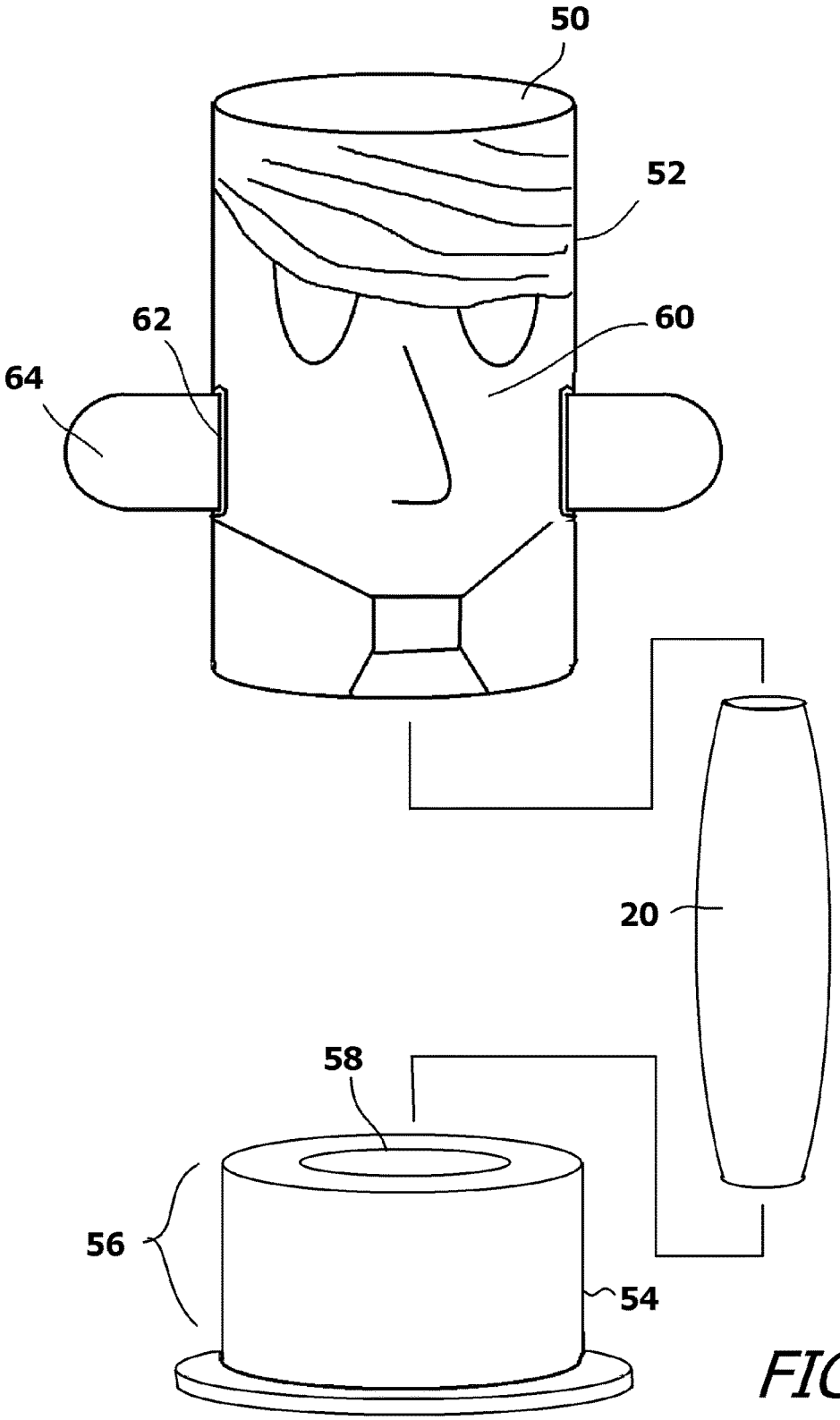
FIG. 5 shows an alternate embodiment of a vibrating toy assembly.

Referring to FIG. 5, an alternate embodiment of a toy assembly 50 is shown. In this embodiment, the same internal vibration mechanism 20 is used. As such, the vibration mechanism 20 is identified with the same reference number as was previously used. In this embodiment, the body casing 52 of the toy assembly 50 is shaped as a cylindrical tube. The body casing 52 is made by bending a blank of cut paper. A base 54 is provided that has a cylindrical support wall 56. An opening 58 in the center of the support wall 56 can serve directly as a receptacle that receives the vibration mechanism 20.

Graphics 60 are printed onto the body casing 52. Additionally, slots 62 are formed in the body casing 52 so that folded segments of paper 64 can serve as extending appendages.

It will be understood that the embodiments of the present invention that are illustrated and described are merely exemplary and that a person skilled in the art can make many variations to those embodiments. All such alternate embodiments are intended to be included within the scope of the present invention as defined by the claims.

What is claimed is:

1. A vibrating toy assembly, comprising:

a vibration mechanism having housing, wherein said housing retains a motor and batteries, and wherein said vibration mechanism causes said housing to vibrate when said motor is activated;

a base having a bottom plate and a vertical conduit that extends from said bottom plate, wherein said vertical conduit is sized to receives and retains said vibration mechanism, wherein said base is moved by said vibration mechanism when said vibration mechanism is activated;

a body casing that defines a hollow internal compartment, wherein said body casing has an open bottom that provides access to said hollow internal compartment, wherein said vertical conduit of said base passes into said open bottom of said body casing and said body casing rests atop said bottom plate of said base, wherein said body casing moves with said base and said body casing shields said vibration mechanism from view.

2. The assembly according to claim 1, wherein said housing of said vibration mechanism rest upon said bottom plate of said base in said hollow internal compartment.

3. The assembly according to claim 2, wherein an opening is disposed in said bottom plate of said base.

4. The assembly according to claim 3, wherein said housing of said vibration mechanism extends into said opening within said bottom plate.

5. The assembly according to claim 3, wherein said housing is elongated between two ends and said vertical conduit orients said housing so that one of said two ends extends into said opening within said bottom plate.

6. The assembly according to claim 1, wherein said body casing is fabricated from folded paper.

7. The assembly according to claim 6, wherein graphics are printed on said body casing that provide said body casing with an external appearance of a character.

8. The assembly according to claim 6, wherein said body casing is rectangular in shape, being fabricated from said folded paper.

9. The assembly according to claim 6, wherein said body casing is cylindrical in shape.

10. The assembly according to claim 1, further including appendages that extend from said body casing and prevent said body casing from falling flat when tipped onto at least one of said appendages.

11. A vibrating toy assembly, comprising:

a vibration mechanism that vibrates when activated, wherein said vibration mechanism is embodied in a housing that is elongated between two ends;

a body casing formed from folded paper, wherein said body casing defines an internal compartment with an open bottom; and a base having a bottom plate and a vertical conduit that extends from said bottom plate, wherein said vertical conduit is sized to receives and retains said housing of said vibration mechanism, and wherein vertical conduit extends into said open bottom of said body casing, therein enabling said base to support both said vibration mechanism and said body casing, wherein said vibration mechanism causes said base to vibrate and move when activated.

12. The assembly according to claim 11, wherein said vibrating toy assembly rests upon said bottom plate within said vertical conduit.

13. The assembly according to claim 12, wherein an opening is disposed in said bottom plate of said base.

14. The assembly according to claim 13, wherein one of said two ends of said housing extends into said opening within said bottom plate.

15. The assembly according to claim 11, wherein graphics are printed on said body casing that provide said body casing with an external appearance of a character.

* * * * *